US008336153B2

(12) United States Patent
Galbreath

(10) Patent No.: US 8,336,153 B2
(45) Date of Patent: Dec. 25, 2012

(54) CLEANING DEVICE

(76) Inventor: Diana L. Galbreath, Manchaca, TX (US)

( * ) Notice: Subject to any disclaimer, the term of this patent is extended or adjusted under 35 U.S.C. 154(b) by 326 days.

(21) Appl. No.: 12/796,404

(22) Filed: Jun. 8, 2010

(65) Prior Publication Data

US 2011/0296637 A1 Dec. 8, 2011

(51) Int. Cl.
*A47L 25/00* (2006.01)

(52) U.S. Cl. ..... 15/114; 15/210.1

(58) Field of Classification Search ..... 15/114, 15/210.1, 117, 146, 160
See application file for complete search history.

(56) References Cited

U.S. PATENT DOCUMENTS 1,510,898 A * 10/1924 Nikicser ..... 15/223
2,251,853 A * 8/1941 Pandiyan ..... 15/176.2
4,829,622 A 5/1989 O'Sullivan
4,887,994 A 12/1989 Bedford
D336,697 S 6/1993 Stalf
D371,655 S 7/1996 Weston
6,601,264 B1 8/2003 Hendricks
7,334,287 B2 2/2008 Tanaka et al.
7,356,869 B2 4/2008 Knopow et al.
7,373,686 B2 * 5/2008 Foster et al. ..... 15/207.2
7,546,657 B2 6/2009 Gurley

* cited by examiner

*Primary Examiner* — Shay Karls
(74) *Attorney, Agent, or Firm* — Dale J. Ream

(57) ABSTRACT

A cleaning device includes a handle member having opposed first and second ends and defining an imaginary longitudinal axis. A brush member is fixedly attached to the first end of the handle and extends outwardly along the axis. The cleaning device also includes an attachment member fixedly attached to the second end of the handle and extending outwardly along the axis. A pad member includes a configuration that is substantially similar to a configuration of the pad holding member and removably coupled thereto.

9 Claims, 4 Drawing Sheets

CLEANING DEVICE

BACKGROUND OF THE INVENTION

This invention relates generally to cleaning devices and, more particularly, for a handheld cleaning device particularly configured to clean cracks, corners, and other locations for which traditional cleaning tools are ineffective.

When cleaning kitchen surfaces, a car dashboard or console, or between adjacent furniture pieces, there are inevitably small areas that do not get cleaned primarily because the cleaning tool is not properly configured or does not include the right surface features to make contact with the surface that needs to be cleaned. For example, a traditional duster, a wash cloth, or long-bristled brush does not reach into corners, cracks, or other recesses typically found in home or car environments.

Various devices have been proposed in the art for cleaning household and vehicle surfaces, such as feather dusters, scouring pads, and brushes of large and small sizes. Although assembly effective for their intended purposes, the existing devices and proposals do not provide a handheld cleaning device for cleaning narrow surfaces such as cracks, crevices, corners, and small spaces. Further, the existing devices do not include replaceable cleaning surfaces in conjunction with other narrow space cleaning features.

Therefore, it would be desirable to have a cleaning device that remedies all of the deficiencies in existing cleaning products as noted above in a single, multi-purpose device.

SUMMARY OF THE INVENTION

A cleaning device according to the present invention includes a handle member having opposed first and second ends and defining an imaginary longitudinal axis. A brush member is fixedly attached to the first end of the handle and extends outwardly along the axis. The cleaning device also includes an attachment member fixedly attached to the second end of the handle and extending outwardly along the axis. A pad member includes a configuration that is substantially similar to a configuration of the pad holding member and removably coupled thereto.

Therefore, a general object of this invention is to provide a cleaning device that is particularly configured to contact surfaces or to fit between adjacent objects that traditional cleaning devices can not clean effectively.

Another object of this invention is to provide a cleaning device, as aforesaid, that includes a brush member and replaceable pad member.

Still another object of this invention is to provide a cleaning device, as aforesaid, that includes a generally linear configuration for reaching hard to clean areas.

Yet another object of this invention is to provide a cleaning device, as aforesaid, that is easy to use and cost-effective to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A cleaning device according to a preferred embodiment of the present invention will now be described with reference to FIGS. 1 to 4*b* of the accompanying drawings. The cleaning device 10 generally includes a handle member 20, brush member 40, and attachment member 50.

Figure 1:
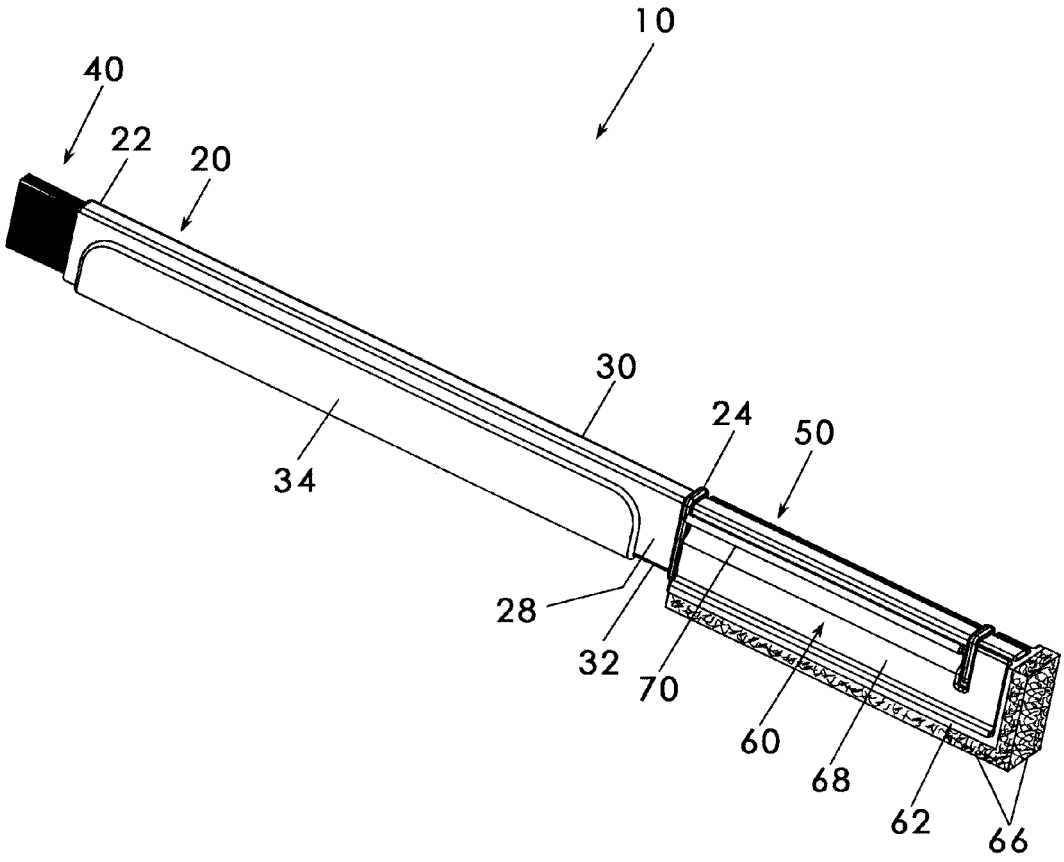
FIG. 1 is a perspective view of a cleaning device according to a preferred embodiment of the present invention.
Figure 2:
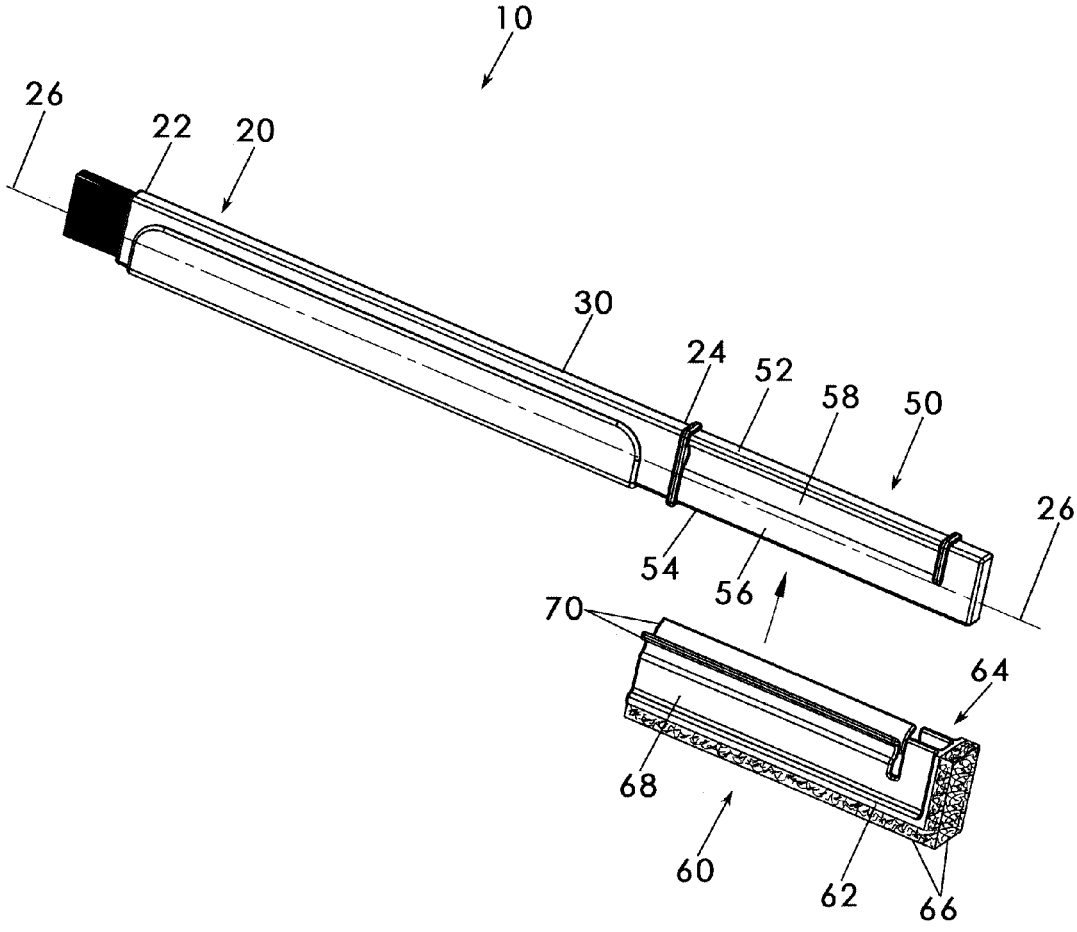
FIG. 2 is an exploded view of the cleaning device as in FIG. 1.

More particularly, the cleaning device 10 includes a handle member 20 having opposed first 22 and second 24 ends. The handle member 20 has an elongate and generally linear configuration that defines an imaginary longitudinal axis 26 (FIG. 2). The handle member 20 presents a thin and narrow configuration (also referred to herein as a "thin-line" configuration) having opposed side walls 28 that present a height dimension that is longer than a width dimension of respective top 30 and bottom 32 walls that connect the handle member side walls 28 (FIGS. 1 and 2). A grip material 34, such as tactile rubber or the like, is attached to at least the side walls 28 of the handle member 20 and extends substantially between first 22 and second 24 ends thereof so as to enhance a person's grip on the handle member 20 in use.

The brush member 40 is fixedly attached to the first end 22 of the handle member 20 and extends outwardly along the longitudinal axis 26 thereof. Preferably, the brush member 40 includes a plurality of bristles that extend forwardly in the direction of the longitudinal axis 26 and away from the handle member first end 22. (FIGS. 1 and 2). The brush member 40 includes a configuration that is substantially similar to the configuration of the handle member 20. More particularly, the brush member 40 has a narrow profile with dimensions such that both the brush member 40 and handle member 20 may be inserted between objects such as furniture or in narrow cracks/crevices when in use.

Figure 4A:
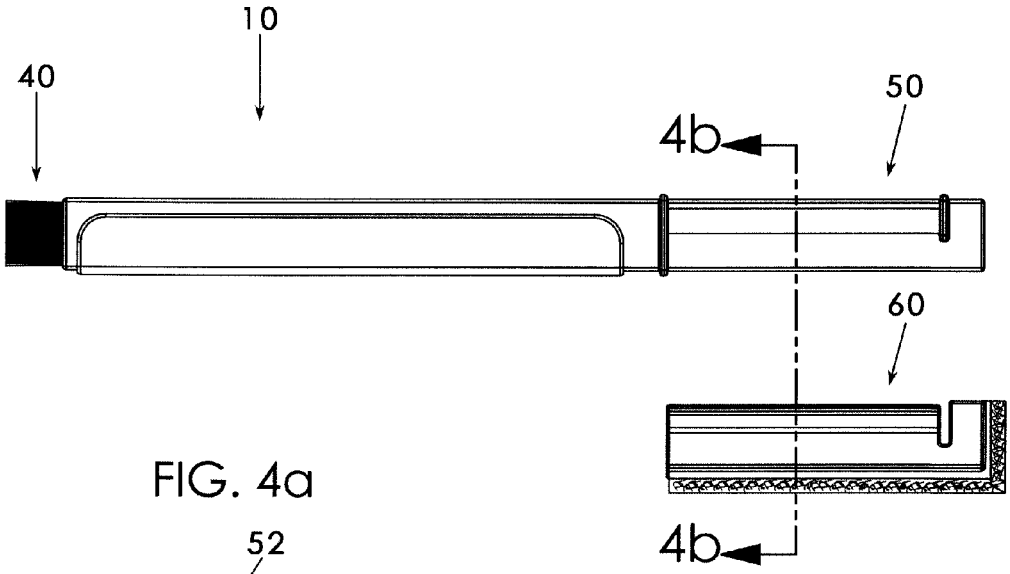
FIG. 4*a* is a side view of the cleaning device as in FIG. 2.
Figure 4B:
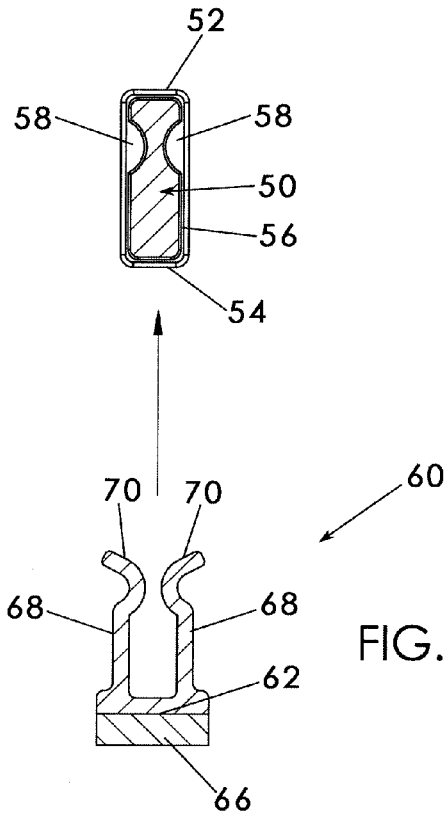
FIG. 4*b* is a sectional view taken along line 4*b*-4*b* of FIG. 4*a.*

The attachment member 50 also includes a configuration substantially similar to the handle member 20. More particularly, the attachment member 50 includes a top wall 52 and a bottom wall 54 each having a width that is substantially the same as that of the handle member 20. Further, the attachment member 50 includes opposed side walls 56 extending between respective attachment member top 52 and bottom 54 walls. At least one of the attachment member side walls 56 defines a recess 58, the function of which will be described below (FIGS. 2 and 4*b*). Of course, both attachment member side walls 56 may include similar recesses.

Figure 3A:
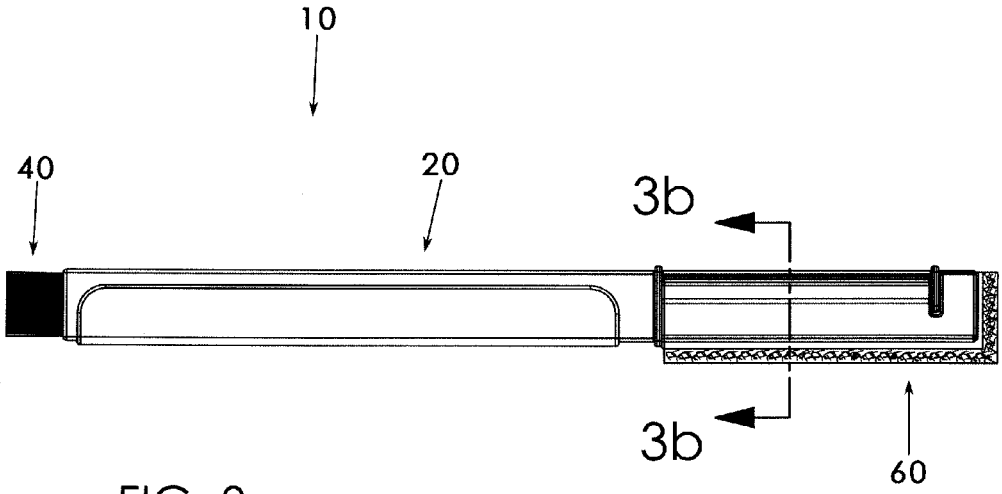
FIG. 3*a* is a side view of the cleaning device as in FIG. 1.
Figure 3B:
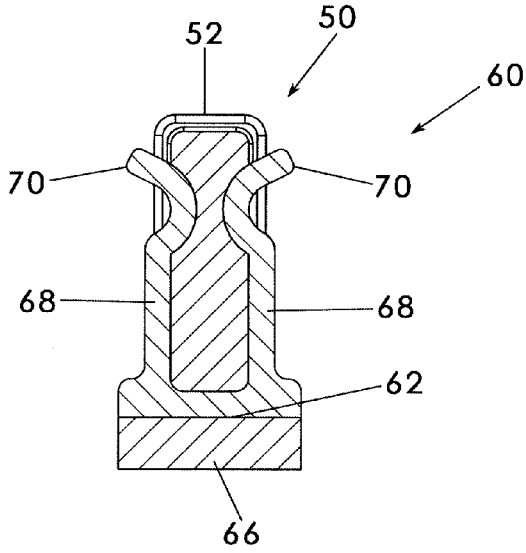
FIG. 3*b* is a sectional view taken along line 3*b*-3*b* of FIG. 3*a;*

The cleaning device 10 also includes a pad member 60 that is removably coupled to the attachment member 50. In other words, the pad member 60, after use, may be selectively removed from attachment to the attachment member 50 and replaced with an unused pad member 60 (FIGS. 1 and 2). The pad member 60 includes a base 62 and a distal end 64 extending upwardly from an end of the base 62, the distal end 64 having a cleaning pad 66 attached thereto, such as a scouring pad or the like (FIG. 4*a*). The cleaning pad 66 also extends along a lower surface of the base 62. Further, at least one prong 68 or wall extends upwardly from the base 62 and includes an inwardly extending flange 70 that is complementary to a corresponding recess 58 defined by the attachment member prong 68 so as to nest therein in a friction fit relationship (FIG. 4*b*). In an embodiment in which both side walls of the attachment member 50 define recesses, the pad member 60 may include two corresponding prongs. In use, a pad member 60 may be snappably coupled to the cleaning device attachment member 50 as best shown in FIGS. 4*b* and 3*b*).

In use, a used pad member 60 may be removed from the attachment member 50 and a new one snapped on. A user may then grasp the handle member 20 by the grip material and manipulate the brush member 40 or pad member 60 against a surface that needs to be cleaned. The streamlined configuration also enables the brush member to be inserted between adjacent pieces of furniture, between cracks in a countertop or appliance surface, into a corner, or the like. The pad member 60 may include a scouring pad and be useful to scrub a counter, wall, or floor surface. When the pad itself is used up, the pad member 60 may again be removed and replaced.

It is understood that while certain forms of this invention have been illustrated and described, it is not limited thereto except insofar as such limitations are included in the following claims and allowable functional equivalents thereof.

What is claimed is:

1. A cleaning device, comprising:

a handle member having opposed first and second ends and defining an imaginary longitudinal axis;

a brush member fixedly attached to said first end of said handle and extending outwardly along said axis;

an attachment member fixedly attached to said second end of said handle member and extending outwardly along said axis;

a pad member having a configuration that is complementary to a configuration of said attachment member and removably coupled thereto;

wherein said attachment member includes:

a top wall and a bottom wall each having a width that is the same as a width of respective handle member top and bottom walls;

opposed side walls extending between said top and bottom walls of said attachment member, at least one of said attachment member side walls defining a recess;

wherein said pad member includes:

a base;

at least one prong extending upwardly from said base, said at least one prong being constructed of a flexible material and having a configuration that is complementary to said at least one attachment member recess such that said pad member is removably coupled to said attachment member in a friction fit relationship; and a cleaning pad attached to an underside of said pad member base and to an outer surface of a pad member distal end.

2. The cleaning device as in claim 1, wherein said handle member includes a thin-line configuration having opposed side walls with top and bottom walls connecting respective side walls.

3. The cleaning device as in claim 2, wherein said side walls include a height that is longer than a width of said top and bottom walls.

4. The cleaning device as in claim 3, wherein said brush member includes a configuration complementary to a configuration of said handle member.

5. The cleaning device as in claim 4, further comprising a grip material attached to each said handle member side wall.

6. The cleaning device as in claim 5, wherein said grip material extends substantially between said first and second ends of said handle member.

7. The cleaning device as in claim 6, wherein said attachment member includes:

a top wall and a bottom wall each having a width that is the same as a width of respective handle member top and bottom walls; and opposed side walls extending between said top and bottom walls of said attachment member, at least one of said attachment member side walls defining a recess.

8. The cleaning device as in claim 7, wherein said pad member includes:

a base; and at least one prong extending upwardly from said base, said at least one prong being constructed of a flexible material and having a configuration that is complementary to said at least one attachment member recess such that said pad member is removably coupled to said attachment member in a friction fit relationship.

9. The cleaning device as in claim 8, further comprising a cleaning pad attached to an underside of said pad member base and to an outer surface of a pad member distal end.

* * * * *